United States Patent [19]

Born et al.

[11] 4,455,124

[45] Jun. 19, 1984

[54] AUTOMATIC PRESSURE SETTING ADJUSTMENT FOR A PRESSURE COMPENSATED PUMP

[75] Inventors: Ellis H. Born; William H. Meisel, both of Columbus; Paul B. Wolfe, Dublin, all of Ohio

[73] Assignee: Abex Corporation, Stamford, Conn.

[21] Appl. No.: 450,839

[22] Filed: Dec. 20, 1982

[51] Int. Cl.³ ..... F04B 49/00

[52] U.S. Cl. ..... 417/218; 60/429; 60/452; 417/216; 417/217; 417/222

[58] Field of Search ..... 417/216–222; 60/452, 428, 429

[56] References Cited

U.S. PATENT DOCUMENTS

| | | | |
|---|---|---|---|
| 3,874,173 | 4/1975 | Wilkins | 60/420 |
| 3,908,519 | 9/1975 | Born et al. | 417/222 X |
| 4,029,439 | 6/1977 | Adams | 60/428 X |
| 4,158,529 | 6/1979 | Nonnenmacher et al. | 417/218 X |
| 4,336,003 | 6/1982 | Kramer et al. | 417/217 |
| 4,364,230 | 12/1982 | Holmes | 417/218 X |

*Primary Examiner*—Edward K. Look

*Attorney, Agent, or Firm*—Thomas S. Baker, Jr.

[57] ABSTRACT

A pressure compensated pump which supplies fluid to a common header has an automatic pressure compensator adjustment mechanism which adjusts the pressure setting of the pressure compensator in response to changes in the displacement of the pump, such that the compensator pressure setting of the pump is reduced when the displacement of the pump increases to increase pump flow and the pressure setting is increased when the displacement of the pump decreases to reduce pump flow.

2 Claims, 3 Drawing Figures

AUTOMATIC PRESSURE SETTING ADJUSTMENT FOR A PRESSURE COMPENSATED PUMP

BACKGROUND OF THE INVENTION

This invention relates to a variable displacement pressure compensated pump. More specifically, it relates to a device for automatically adjusting the pressure setting of the pressure compensator as the displacement of the pump changes to thereby synchronize the displacement of the pump with that of other pressure compensated pumps in a system in which multiple variable displacement, pressure compensated pumps are supplying fluid to a common header.

DESCRIPTION OF THE PRIOR ART

A variable displacement pressure compensated pump provides an output of hydraulic fluid at a constant set pressure. In a typical pressure compensated pump, the displacement control is biased towards a full on-stroke or maximum displacement position. The displacement control moves toward the maximum displacement position until the outlet pressure of the pump reaches a set value. When it exceeds the set value, pressure fluid from the outlet of the pump is diverted to a displacement changing mechanism and the displacement of the pump is reduced until the pressure of the fluid in the outlet is reduced to the set value. If the pressure of the outlet fluid falls below the set value, pressure fluid is drained from the displacement changing mechanism and the biasing device moves the mechanism towards the maximum displacement position. The mechanism moves the pump more on-stroke until the outlet fluid pressure reaches the set value.

In one pressure compensated pump, the pressure setting of the pressure compensator is set by a spring which acts against one end of a compensator spool. Outlet pressure fluid acts against the opposite end. The spool has a central land one side of which is connected to outlet pressure fluid and the other side is connected to drain. This land moves across a control port connected to a stroking piston. When the pump outlet pressure is below the compensator setting, the spring-biased spool is in a position in which the drain side of the spool is connected to the control port and fluid is drained from the stroking piston. This allows a rate-spring which opposes the stroking piston to bias the pump hanger towards the full on-stroke position. When the pump outlet pressure reaches the set pressure, the spool is stationary and the outlet pressure holds the stroking piston in place to maintain the set pressure. When the pump outlet pressure exceeds the set value, the outlet pressure fluid acting on the spool end causes the land to move across the control port and additional outlet pressure fluid is supplied to the stroking piston. The force of the stroking piston overcomes the rate-spring and moves the hanger to reduce the displacement of the pump.

In a pressure compensated pump shown in U.S. Pat. No. 3,908,519 and assigned to the assignee of the instant invention, fluid flow to the displacement changing mechanism of the pump is controlled by a sequence valve. This valve also provides the pressure setting for the pressure compensator mechanism. When the outlet pressure of the pump is at or below the setting of the sequence valve, the valve poppet is seated and the pump remains in a commanded position. When the setting of the sequence valve is exceeded, the valve poppet is unseated and outlet pressure fluid is directed to the displacement changing mechanism to reduce pump displacement. Pump displacement is reduced until outlet pressure is at the set value. If the outlet pressure falls below the set value, the pump's servo controlled displacement changing mechanism moves the pump more on-stroke until the set displacement position is reached or the pump outlet pressure is at its set value.

Frequently, it is necessary to connect the outlet of more than one variable displacement, pressure compensated pump to one or more common pressure headers. An example of this is where one pump cannot provide sufficient fluid to drive a particular device. A problem with connecting two or more variable displacement, pressure compensated pumps to a common header is that it is difficult to get multiple pressure compensated pumps to operate at substantially the same displacement at all times. The reason multiple pumps may not operate at the same displacement is that if the pressure compensator setting of one pump is slightly above the setting of the compensator of another pump (which easily can occur due to manufacturing variations), the pump with the higher setting continues to increase in displacement in an effort to have its outlet fluid reach its set pressure after the pump with the lower setting has reached its setting. As the displacement of the pump with the higher setting increases further in an attempt to reach its set pressure, the pump with the lower setting will decrease in displacement in an attempt to keep its outlet pressure at the set value. Consequently, the pump with the lower setting swallows oil from the pump with the higher setting. Subsequently, the pumps may reverse roles. This results in a waste of power, increased wear in the gear trains and reduced fluid flow power available to the circuit.

In some systems which employ multiple, pressure compensated pumps connected to a common header, the displacements of the pumps can be made to follow each other rather closely through the use of fixed trimming orifices placed in the vent lines. In a pressure compensated pump, a vent line is connected in parallel with a poppet or other device which provides the maximum compensator setting for the pressure in the outlet of the pump. The vent line permits a device, such as a remote operated valve, to provide a second compensator pressure setting for the pump. In this way, the compensator setting of the pump readily can be changed. A problem with installing trimming orifices in the vent lines of pumps connected to a common header is that it does not always keep the pressure compensator settings of the pumps equal under all conditions. Consequently, it is desirable to provide a mechanism for a variable displacement, pressure compensated pump which is connected to a common header, which mechanism will automatically adjust the pressure setting of the pressure compensator of the pump, such that the displacement of the pump is synchronized with the displacements of other pumps equipped with the mechanism.

SUMMARY OF THE INVENTION

The instant invention provides a variable displacement, pressure compensated pump having its outlet connected to a fluid header. The pump includes a pressure compensator mechanism which senses the outlet pressure of the pump and includes a means for providing a pressure setting for the pressure compensator. An automatic adjustment mechanism is provided which adjusts the pressure setting of the pressure compensator in response to changes in the displacement of the pump, such that the compensator setting of the pump is reduced when the displacement of the pump increases to increase pump flow and the setting is increased when the displacement of the pump decreases to reduce pump flow. This prevents the pump from going further on or off stroke when another pressure compensated pump connected to the common header is changing displacement in the opposite direction, and thereby synchronizes the displacements of the pumps, provided both have the automatic control device.

DESCRIPTION OF THE PREFERRED EMBODIMENT

Figure 1:
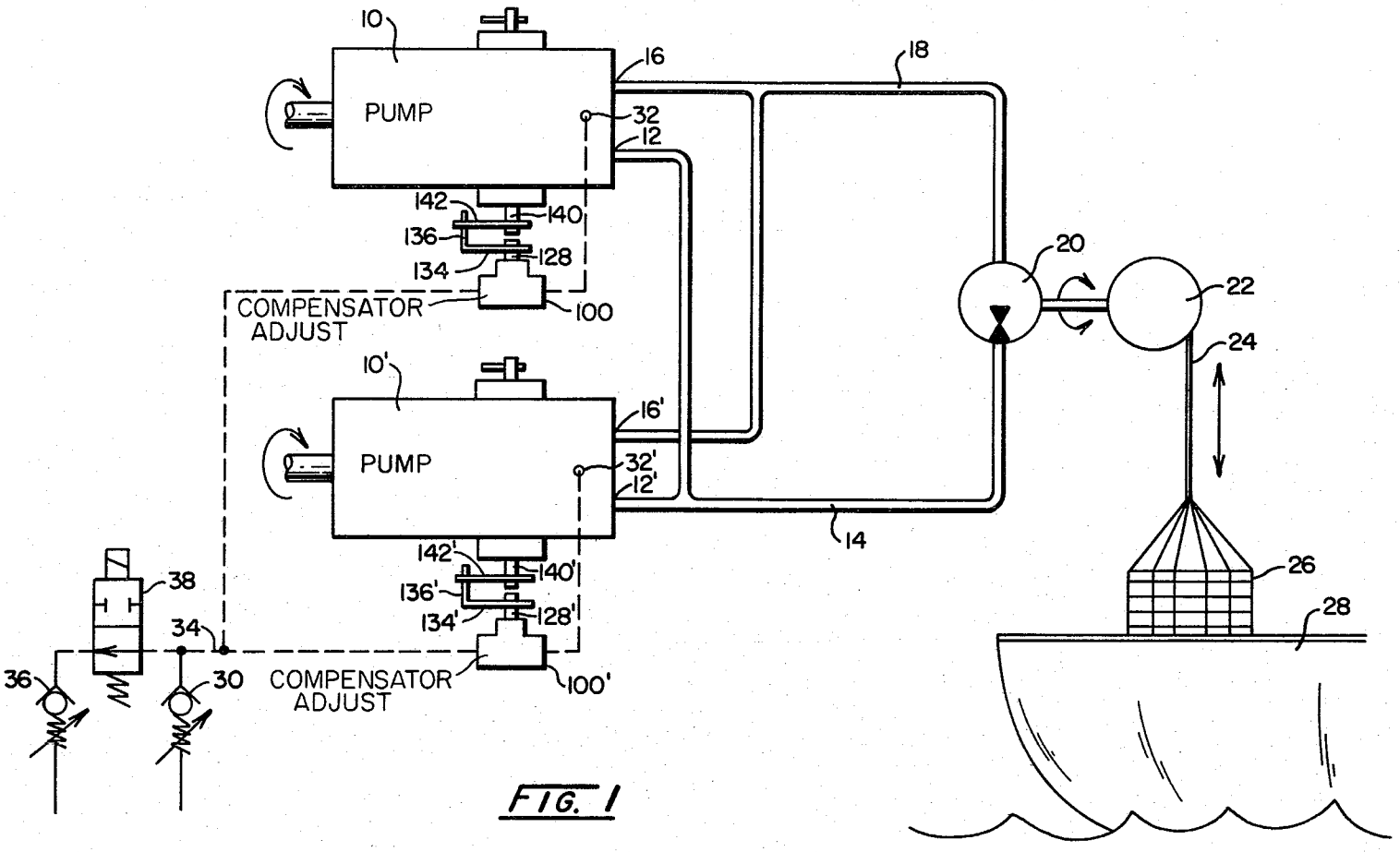
FIG. 1 is a schematic view of the hydraulic system comprising two variable displacement, pressure compensated pumps equipped with the automatic compensator adjustment mechanism of the instant invention and connected to a pair of common headers which supply fluid to drive a hydraulic motor attached to a winch.

Referring to FIG. 1, a pair of variable displacement, pressure compensated pumps 10, 10′ have their outlet ports 12, 12′, respectively, connected in parallel to a pressure header 14 and their inlet ports 16, 16′, respectively, connected in parallel to a pressure header 18. Pump 10 is identical to pump 10′ and elements of 10′ corresponding to those of pump 10 are identified by identical primed numbers. This description will refer to pump 10.

The pressure headers 14, 18 are connected to a fluid motor 20 which, in turn, is connected to a winch 22. A line 24 on winch 22 is attached to a load of cargo 26 on the deck of a ship 28. In the system shown in FIG. 1, pumps 10, 10′ provide high pressure fluid to pressure header 14 when motor 20 is driven to raise the load of cargo 26. Pumps 10, 10′ are in a wave following mode and act to keep line 24 taut when cargo 26 is resting on the deck of ship 28. When waves move the ship toward winch 22 pumps 10, 10′ provide pressure fluid to motor 20 to inhaul line 24. When the ship 28 is moving away from winch 22, cargo 26 pulls on line 24 and causes winch 22 to pay out line 24 which causes motor 20 to be driven by the winch 22. This forces motor 20 to act as a pump and high pressure fluid is supplied by motor 20 to pressure header 14. The high pressure fluid supplied to header 14 passes into ports 12, 12′ of pumps 10, 10′ and causes the displacement control of each, described hereinafter, to go across center and thereby permit the pumps 10, 10′ to act as motors and swallow the fluid supplied from motor 20. At all times pressure header 14 sees only high pressure fluid and pressure header 18 sees only low pressure fluid. Consequently, a pressure compensator adjustment mechanism is required only for the pressure compensator pressure setting device controlling the pressure in port 12.

When cargo load 26 is lifted from the deck of ship 28, the pressure compensators, described hereinafter, of pumps 10, 10′ must have their pressure settings set high enough that the pressure of the outlet fluid in header 14 is sufficient to drive fluid motor 20 and cause winch 22 to raise the load 26. In the instant system, setting of the pressure compensator to lift load 26 is provided by an adjustable pressure setting relief valve 30. Valve 30 is connected to the vent ports 32, 32′ of the pumps 10, 10′, respectively, by a vent line 34. In a typical winch system adjustable pressure setting valve 30 may be set for 3,000 psi. A second adjustable pressure setting relief valve 36 is used to provide the pressure setting for the compensators of the pumps 10, 10′ when pumps 10, 10′ are in the wave following mode. Valve 36 may have a setting of 1,000 psi. Valve 36 provides the pressure setting for the pressure compensators of the pumps 10, 10′ when a remote valve 38 connected in line 34 between valves 30, 36 is shifted to the position shown in FIG. 1, such that pressure setting valve 36 is connected to vent line 34 in parallel with pressure setting valve 30. Since valve 36 has a lower setting than valve 30, it will unseat first. When valve 38 is shifted to disconnect valve 36 from vent line 34, valve 30 provides the pressure setting for the pump compensators.

Figure 2:
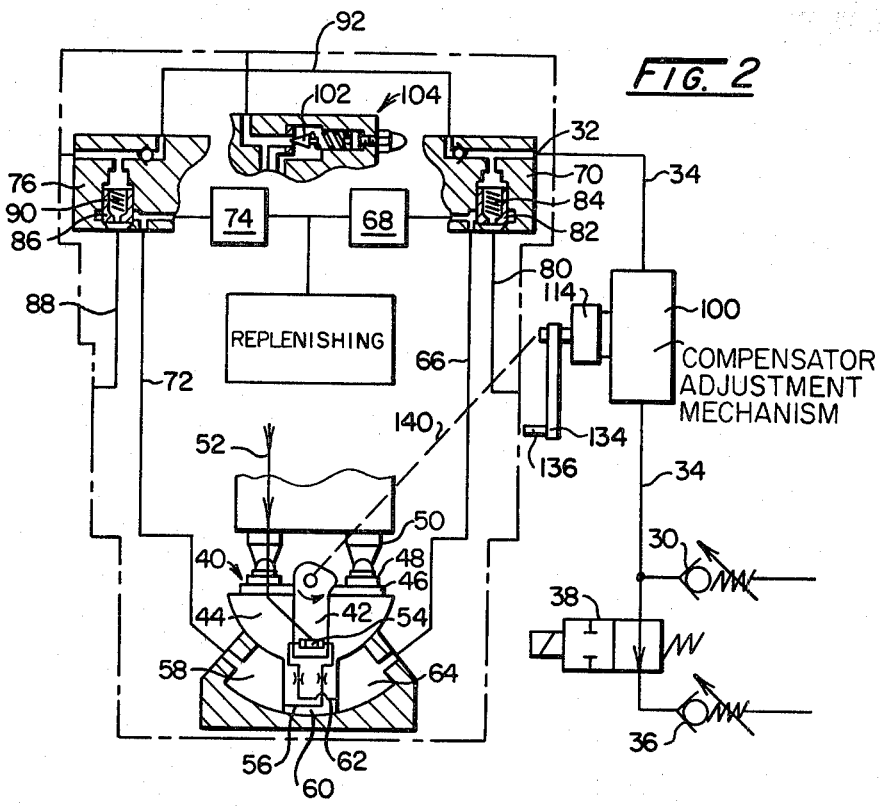
FIG. 2 is a detailed schematic diagram of a variable displacement, pressure compensated pump with the automatic compensator adjustment mechanism of the instant invention.

Referring to FIG. 2, the operation of the pressure compensator mechanism of pump 10 next will be described. Although FIG. 2 illustrates the operation of the pressure compensator mechanism of pump 10, it does not illustrate the complete control system for pump 10. A description of the complete control system for pump 10 is described in aforementioned U.S. Pat. No. 3,908,519 which hereby is incorporated by reference thereto into this application.

The displacement of pump 10 is controlled by a displacement mechanism 40. Included within mechanism 40 is a manual, rotary servo valve having an input arm 42. The angular position of input arm 42 sets the angular position of a rocker cam 44 on which is mounted the thrust plate 46 of the pump 10. Pump 10 is a piston pump and fluid is displaced as shoes 48 attached to pistons 50 slide over plate 46 and cause the pistons 50 to reciprocate and pump fluid in a well known manner. When rocker cam 44 is in the center or neutral position, shown in FIG. 2, pump 10 is in the neutral or minimum displacement position. In order to put pump 10 on stroke, input control arm 42 is pivoted to the desired rocker cam position. In FIG. 2 the arrow illustrates the direction (counterclockwise) arm 42 is pivoted in order that pump outlet port 12 is the high pressure port. When arm 42 is pivoted with respect to rocker cam 44, servo pressure fluid is supplied from a line 52 to a servo valve mechanism 54. Fluid flows through mechanism 54 and a line 56 into a vane chamber 58. As the volume of fluid chamber 58 increases it pivots a vane 60 affixed to rocker cam 44 to thereby pivot the rocker cam. The servo valve mechanism 54 stops rocker cam 44 from pivoting when it has pivoted the same number of degrees as arm 42 has been displaced. If arm 42 is pivoted clockwise from the neutral position, servo fluid in line 52 flows through servo valve mechanism 54 and line 62 into a vane chamber 64 to thereby bias vane 60 and rocker cam 44 in the clockwise direction. As rocker cam 44 is moved towards the neutral position, pump displacement is reduced. If rocker cam 44 is pivoted beyond the neutral position, the pump 10 goes on stroke in the other direction, and displaces pressure fluid from the other port 16.

When servo pressure fluid is supplied to chamber 58 and vane 60 and rocker cam 44 are pivoted counterclockwise, fluid is displaced from vane chamber 64 through the servo valve mechanism 54 as set forth in the aforementioned patent. Likewise, when vane 60 and rocker cam 44 are pivoted clockwise, fluid is displaced from chamber 58 through the servo valve mechanism 54.

A line 66 connects vane chamber 64 with a relief valve 68 and the outlet of a sequence valve 70. A line 72 connects vane chamber 58 with a relief valve 74 and the outlet of a sequence valve 76. In pump 10, high pressure fluid from outlet port 12 is supplied through a line 80 to the bottom of a poppet 82 in sequence valve 70. Poppet 82 is biased against its seat by a spring 84. The outlet of sequence valve 70 is connected to relief valve 68 and vane chamber 64, as previously mentioned. In pump 10, port 16 is connected to the bottom of a poppet 86 in sequence valve 76 by a line 88. Poppet 86 is biased against its seat by a spring 90. The outlet of sequence valve 76 is connected to relief valve 74 and to vane chamber 58 as mentioned above. The tops of poppet 82 in sequence valve 70 and of poppet 86 in sequence valve 76 are connected to adjustable pressure setting relief valves 30, 36 through vent port 32, line 34, and an automatic compensator adjustment mechanism 100. Poppets 82 and 86 are also connected to the pilot stage 102 of an adjustable high pressure, control valve 104 through line 92. Pressure control valve 104 provides a maximum pressure setting for sequence valves 70, 76 in the same manner as pressure setting relief valves 30, 36. Valve 104 provides the pressure setting for the sequence valves 70, 76 when pump 10 is not feeding to a common header and is acting alone. Valve 104 sets valves 70, 76 at the maximum allowable system pressure which may be on the order of 5,000 psi.

The pressure compensator mechanism for high pressure port 12 of the instant invention operates as follows. The compensator mechanism for port 16 operates in a similar manner. However, since it is connected to the low pressure port 16 it does not operate in the instant system. High pressure fluid in port 12 of pump 10 is supplied through line 80 to the bottom of sequence valve poppet 82. This high pressure fluid can be from the output of pump 10 supplying high pressure fluid to motor 20 to drive winch 22 and thereby lift a load of cargo 26, or it can be from pressure fluid supplied to port 12 when pump 10 is in the wave following mode. In the instant invention the compensator mechanism only operates when pump 10 is in the wave following mode.

When the pressure of the fluid acting on the bottom of poppet 82 exceeds the setting of sequence valve 70, which is set by relief valve 36 connected to the top of poppet 82 plus the value of spring 84 poppet 82 will lift from its seat. This allows high pressure fluid to flow through line 66 into vane chamber 64 and push vane 60 towards the neutral position. For a brief period of time fluid in chamber 58 may flow through line 72 and relief valve 74 to a pump replenishing circuit. Thereafter, fluid in chamber 58 will be exhausted through servo valve mechanism 54. If fluid motor 20 is acting as the pump and supplying pressure fluid to outlet port 12, the pressure fluid will push vane 60 past center such that the pump will be on-stroke in the opposite direction and act as a motor to absorb or swallow fluid from the fluid motor 20. Poppet 82 will reseat as soon as pump displacement is reduced to where the outlet pressure in port 12 and line 80 reaches the compensator setting.

If the pressure in the outlet 12 falls below the setting of valve 70, servo pressure fluid in chamber 58 will act to bias vane 60 and rocker cam 44 counterclockwise towards the full on-stroke position to increase the delivery of fluid to port 12. Vane 60 and rocker cam 44 will pivot counterclockwise until the fluid pressure in outlet 12 reaches the setting of valve 70 and further counterclockwise movement is prevented by high pressure fluid in vane chamber 64. From the above it can be seen that the pressure compensator mechanism includes servo valve mechanism 54, sequence valves 70, 76, relief valves 30, 36, 104 and displacement changing mechanism 42, 52, 58, 64, 68, 74.

The automatic compensator adjustment mechanism 100 of the instant invention which automatically adjusts the pressure setting of the pressure compensator mechanism as the displacement of pump 10 changes in order to synchronize the displacement of the pumps 10, 10' now will be described.

Figure 3:
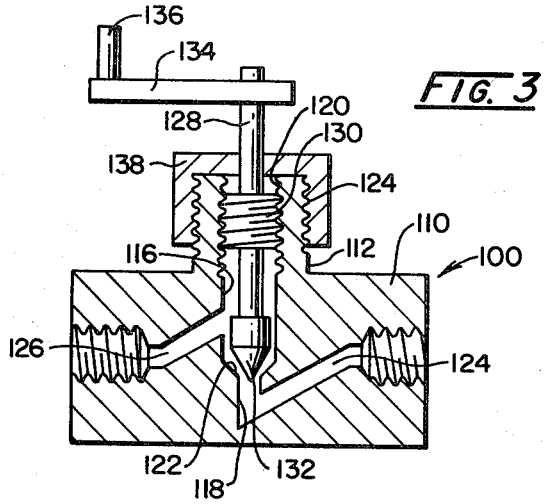
FIG. 3 is an enlarged sectional view of the automatic compensator adjustment mechanism of the instant invention.

Referring to FIG. 3, adjustment mechanism 100 includes a housing 110 having a cylindrical projection 112 on one side thereof, the outer surface 114 of which is threaded. An axial bore 116 is formed in projection 112 which extends into housing 110. The portion 120 of bore 116 within projection 112 is threaded. A tapered seat 122 is formed in the bottom of bore 116. A reduced diameter bore 118 opens into the bottom of seat 122. A fluid passage 124 intersects bore 118 on one side of seat 122 and a fluid passage 126 opens into bore 116 on the other side of seat 122.

A shaft 128 has an enlarged central, externally threaded midsection 130 which is received in threaded portion 120 of bore 116. A conical valve element 132 is mounted on one end of shaft 128 adjacent tapered seat 122. Valve element 132 and seat 122 cooperate to form a variable fluid orifice 122, 132. A cover 138 is threaded onto the outer surface 114 of projection 112 to prevent shaft 128 from backing out of bore 116. An arm 134 has one end rigidly affixed to shaft 128 and has a laterally projecting pin 136 mounted on its other end.

Rotation of shaft 128 in one direction causes valve element 132 to move closer to seat 122 to reduce the size of orifice 122, 132 while rotation of shaft 128 in the opposite direction moves valve element 132 away from seat 122 and enlarges the orifice. Orifice 122, 132 is positioned between fluid passage 124 and fluid passage 126 and a pressure drop occurs as fluid flows through the orifice.

Referring to FIG. 1, an output shaft 140 projects from one side of pump 10. One end of an arm 142 rigidly affixed to shaft 140. Shaft 140 rotates about the same center as rocker cam 44 and is connected to rocker cam 44 such that it rotates with and the same number of degrees as rocker cam 44. Consequently, arm 142 always indicates the exact angular position of cam 44.

Compensator adjustment mechanism 100 is mounted such that shaft 128 is coaxial with output shaft 140 and fluid passages 124, 126 are connected to vent line 34 so that fluid in line 34 passes through orifice 122, 132. Pin 136 on arm 134 of compensator adjustment mechanism 100 is attached to that end of arm 142 opposite the end rigidly attached to shaft 140, such that arm 134 is parallel to arm 142. Thus, rotation of shaft 140 and arm 142 on pump 10 by cam 44 causes equal angular rotation of arm 134 and shaft 128 of compensator adjustment mechanism 100. Shaft 128 is threaded into bore 116 in such a way that as rocker cam 44 is rotated to a position of increased displacement of pressure fluid into port 12 conical valve element 132 moves away from seat 122 to increase the size of orifice 122, 132 and reduce the pressure drop of fluid therethrough. As rocker cam 44 is rotated to a position of reduced displacement, valve element 132 moves toward seat 122 to reduce the size of the orifice and increase the pressure drop of fluid therethrough. Whem pump 10 is in the centered position, valve element 132 cooperates with seat 122 to provide a pressure drop of approximately 100 psi for fluid flow from vent line 32. When rocker cam 44 is in its maximum displacement position for fluid flow into port 12, orifice 122, 132 is enlarged and a pressure drop of approximately 50 psi is provided for fluid flow from vent line 32. When rocker cam 44 is moved clockwise and crosses center to its maximum displacement position for absorbing fluid, orifice 122, 132 is further reduced and a pressure drop of approximately 150 psi is provided for fluid flow from vent line 32. Referring to FIG. 2, it can be seen that the pressure drop of fluid through orifice 122, 132 is added to the setting of relief valves 30, 36 to provide a pressure setting for sequence valve 70.

Operation of the automatic compensator adjustment mechanism 100 to synchronize the displacement of pumps 10 and 10' now will be described. Referring to FIG. 1, in the instant system a compensator adjustment mechanism 100 is mounted on pump 10 and an identical compensator adjustment mechanism 100' is mounted on pump 10'. In order to lift cargo 26 from ship 28, valve 38 is shifted to block the connection of low setting relief valve 36 from line 34. This enables relief valve 30 to provide a setting of approximately 3,000 psi for the sequence valves 70, 76 of pump 10. As previously mentioned, the pressure drop through orifice 122, 132 must be added to the setting of the relief valve 30 to obtain the setting of sequence valves 70, 76. If the pressure drop through the orifice at zero flow is 100 psi and if relief valve 30 has a setting of 3,000 psi, then the compensator setting for the pumps 10, 10' is approximately 3,100 psi with the pump at zero stroke. In order to lift cargo 26 from ship 28, input arm 42 of displacement mechanism 40 is pivoted counterclockwise and displacement of the pumps 10, 10' is increased to cause the cargo 26 to lift from the ship. In normal operation, substantially less than 3,000 psi is required to lift cargo 26, the pressure in ports 12, 12' does not exceed the setting of sequence valve 70, the pressure compensators in the pumps 10, 10' do not operate and compensator adjustment mechanisms 100, 100' are inoperative.

In the instant system the compensator adjustment mechanisms 100, 100' operate when the pumps 10, 10' are in the wave following mode. In this mode they keep line 24 tuat when cargo 26 is resting on the deck of a ship 28 as mentioned above. In the wave following mode valve 38 is shifted to connect low setting relief valve 36 to vent line 34. If valve 36 has a setting of 1,000 psi, that plus the 100 psi drop of mechanism 100 provides a pressure compensator setting of 1,100 psi for the pumps 10, 10' at zero stroke. When wave action is such that ship 28 and cargo 26 move away from winch 22, the weight of cargo 26 forces winch 22 to pay out line 24. This causes winch 22 to drive motor 20 in such a way that motor 20 acts as a pump and pressure in line 14 can exceed 1,100 psi. This causes relief valve 36 to open, sequence valve poppet 82 to unseat and the compensator of pump 10 to operate. This cuases cam 44 of pump 10 to move clockwise across center to absorb fluid. As the angular position of cam 44 changes, arm 142 on pump 10 pivots arm 134 on compensator adjustment mechanism 100 to reduce the size of the variable orifice 122, 132, and thereby increase the pressure drop of fluid therethrough. This increases the setting of sequence valve 70 which provides the setting for the pressure compensator mechanism. In the instant invention the pressure drop will increase approximately 50 psi above the neutral setting of 100 psi if the pump moves full on-stroke in the fluid absorbing direction (clockwise). Pump 10 will continue to change displacement until outlet pressure reaches the adjusted setting of sequence valve 70. When pump 10 reaches the sequence valve setting it will stop changing displacement.

The operation of mechanisms 100, 100' to keep the displacements of pumps 10, 10' equal is as follows. If the setting of the sequence valve in pump 10' is not identical thereto and, in fact, is slightly higher than that of sequence valve 70 in pump 10, it will reach its setting before pump 10 and stop changing displacement first. However, since pump 10 has a lower sequence valve 70 setting it will attempt to further change its displacement. This will cause pressure in header 14 to drop and the compensator mechanism of pump 10' will cause it to increase its displacement as pump 10 is decreasing its displacement. However, as pump 10' increases displacement, its variable orifice in adjustment mechanism 100' opens, the pressure drop of fluid therethrough is reduced and the sequence valve setting of pump 10' is reduced. Thus, it is apparent that the pressure compensator adjustment mechanisms 100, 100' operate such that the pressure setting of the pressure compensator of the pump with the lower setting is increased and the pressure setting of the pressure compensator of the pump with the higher setting is decreased until the pressure settings are identical and the compensator mechanisms cause the displacement mechanisms of the two pumps 10, 10' to follow each other. In actual usage it has been found that the compensator adjustment mechanisms 100, 100' are sensitive to the point that the pressure settings of the pressure compensators of the two pumps 10, 10' are maintained with one psi of each other and the pressure compensator mechanisms of the pumps 10, 10' operate such that the displacement of the two pumps 10, 10' are virtually identical at all times.

When the waves are moving the ship 28 and cargo 26 towards winch 22, the pumps 10, 10' operate motor 20 to inhaul line 24. The pressure in line 14 required to inhaul line 24 is substantially less than 1,100 psi. However, the pumps 10, 10' are commanded to the maximum displacement position at which it would displace more fluid than motor 20 can use. This causes the pressure in header 14 and port 12 to rise until the sequence valve 70 unseats. When valve 70 unseats the displacement of pump 10 changes and movement of rocker cam 44 operates the pressure compensator adjustment mechanism 100 for the pump 10 in exactly the same manner as described above when winch 22 pays out line 24. Operation of the pressure compensator adjustment mechanism 100 is the same whether winch 22 is inhauling or paying out line since pressure port 12 is supplied through line 80 to the bottom of sequence valve 70 in either case. Therefore, the description of operation of pressure compensator adjustment mechanism 100 when winch 22 is inhauling line is not necessary.

Since certain changes may be made in the above-described system and apparatus without departing from the scope of the invention herein involved, it is intended that all matter contained in the description thereof or shown in the accompanying drawings shall be interpreted as illustrative and not in a limiting sense.

We claim:

1. A variable displacement, pressure compensated pump having an outlet which is connected to a fluid header and an inlet, which comprises: pressure compensator means for changing the displacement of the pump when fluid pressure in the pump outlet equals the pressure setting of the pressure compensator including means for providing a pressure setting for the compensator means, means affixed to the pump for sensing the displacement of the pump, means for automatically adjusting the pressure setting of the pressure compensator in response to changes in displacement of the pump, conduit means for connecting the pressure compensator setting means and the automatic compensator adjustment means, and the automatic compensator adjustment means is connected to the displacement sensing means such that it automatically reduces the pressure setting of the pressure compensator when the displacement of the pump increases to increase pump flow and increases the pressure setting of the pressure compensator when the displacement of the pump decreases to reduce pump flow.

2. The pressure compensated pump as described in claim 1, wherein the automatic compensator adjustment means includes an adjustable orifice positioned in the conduit means, the adjustable orifice creates a pressure drop in the conduit means, the means for sensing the displacement of the pump includes an indicator which indicates the displacement of the pump and the adjustable orifice is connected to the displacement indicator such that the opening of the adjustable orifice is increased to reduce the pressure drop therethrough and reduce the pressure setting of the pressure compensator as the displacement of the pump increases to increase pump flow and the opening of the adjustable orifice is decreased to increase the pressure drop therethrough and increase the pressure setting of the pressure compensator as the displacement of the pump decreases to reduce pump flow.

* * * * *